US006535177B1

(12) United States Patent
Dhellemmes et al.

(10) Patent No.: US 6,535,177 B1
(45) Date of Patent: Mar. 18, 2003

(54) METHOD AND A DEVICE FOR POINTING AND POSITIONING A MULTISATELLITE ANTENNA

(75) Inventors: Olivier Dhellemmes, Cahors (FR); Frederic Laplace-Treyture, Villefranche de Rouergue (FR)

(73) Assignee: Manufacture d'Appareillage Electrique de Cahors (FR)

( * ) Notice: Subject to any disclaimer, the term of this patent is extended or adjusted under 35 U.S.C. 154(b) by 0 days.

(21) Appl. No.: 09/868,828

(22) PCT Filed: Dec. 6, 1999

(86) PCT No.: PCT/FR99/03024

§ 371 (c)(1),
(2), (4) Date: Aug. 8, 2001

(87) PCT Pub. No.: WO00/39885

PCT Pub. Date: Jul. 6, 2000

(30) Foreign Application Priority Data

Dec. 23, 1998 (FR) ..... 98 16368

(51) Int. Cl.[7] ..... H01Q 3/02
(52) U.S. Cl. ..... 343/882; 343/765; 343/766
(58) Field of Search ..... 343/757, 765, 343/766, 763, 880, 882

(56) References Cited

U.S. PATENT DOCUMENTS 3,999,184 A * 12/1976 Fuss, III ..... 343/709
5,184,145 A * 2/1993 Devillers et al. ..... 343/840
5,576,721 A * 11/1996 Hwang et al. ..... 343/753
5,760,739 A * 6/1998 Pauli ..... 342/359
5,945,961 A * 8/1999 Price et al. ..... 343/757
6,160,521 A * 12/2000 Palmiter et al. ..... 343/766

* cited by examiner

*Primary Examiner*—Don Wong
*Assistant Examiner*—Shih-Chao Chen
(74) *Attorney, Agent, or Firm*—Bachman & LaPointe, P.C.

(57) ABSTRACT

A method of pointing a fixed antenna (2) having a reflector (10) and at least one transceiver source suitable for aiming at a plurality of satellites situated between two extreme positions $S_1$, $S_2$ on a geostationary orbit (8). According to the invention, the transceiver source is offset on the focal line (6) of the antenna (2) through a distance d from the middle of the focal line (6) so as to aim at one of the extreme positions $S_1$, $S_2$, the distance d being determined as a function of an angle $\alpha$ formed between a first line connecting the origin O of the focal axis of the reflector (10) to the target extreme position and a second line connecting the origin O to the middle position $S_M$ of the geostationary orbit, the reflector (10) is turned through the angle $\alpha$ about an axis D perpendicular to the plane containing the focal line (6) and the origin O of the focal axis, and then the roll angle is adjusted by turning the antenna (2) about its own axis pointing to the satellite situated at the target extreme position, so as to aim at the other extreme position and bring the focal line (6) into alignment with the set of satellites situated between the positions $S_1$, and $S_2$.

15 Claims, 10 Drawing Sheets

METHOD AND A DEVICE FOR POINTING AND POSITIONING A MULTISATELLITE ANTENNA

BACKGROUND OF THE INVENTION

The present invention relates to a method and a device for pointing a fixed antenna having a reflector including at least one transceiver source capable of aiming at a plurality of satellites situated between two extreme positions $S_1$, $S_2$ on a geostationary orbit.

The method and device can also be implemented with an antenna having a source whose radiation pattern is steerable so as to be able to select a selected incident beam from a plurality corresponding to different target orbital positions. It can also be implemented with an antenna provided with a source that is motor-driven along the focal line. In addition, the antenna can be of the following types:

- an antenna with a reflector in a centered configuration having a focal line comprising as many sources as there are target orbital positions; and
- an antenna having a reflector in an offset configuration having a focal line comprising as many sources as there are target orbital positions.

Such antennas are described in document FR 2 746 218, for example, which discloses a support for mounting two converters (transmitter or receiver heads) on a parabolic antenna, and document FR 2 701 337 describes a support for a plurality of receiver heads on a parabolic antenna.

The invention also applies to an array antenna with azimuth scanning.

FIGS. 1, 2, and 3 illustrate a known method of pointing a multi-satellite antenna having a centered-configuration reflector with a plurality of sources on its focal line. This pointing consists in aiming at the intermediate orbital position $S_M$ where a middle satellite is located, halfway angularly between the extreme positions $S_1$ and $S_2$. For this purpose, the antenna is turned about an azimuth axis A and about an elevation axis B as shown in FIG. 4. To align the reflector and the plane containing the sources on the plane $OS_1S_2$, the antenna is turned about its own axis pointing at the orbital position $S_M$ through a roll angle i, and then the spacing between the sources is adjusted so as to receive all of the orbital positions.

The principle on which such an antenna receives is illustrated in FIGS. 2 and 3 which show two intermediate target orbital positions $S_3$ and $S_4$ situated between the two extreme orbital positions $s_1$ and $s_2$. The idea is to align the transceiver sources $s_1$, $s_2$, $s_3$, $s_4$, and $s_m$ on the positions $S_1$, $S_2$, $S_3$, $S_4$, and $S_M$. Error calculation shows that if the antenna is accurately aligned on $S_1$ and $S_2$, then the error on $S_3$, $S_4$, and $S_x$ is relatively small and, to a first approximation, it is possible to assume that the orbital positions $S_1$, $S_2$, $S_3$, $S_4$ and $S_M$ all line in the same plane $OS_1S_2$.

The above-described prior art pointing method works providing it is possible to rely on the orbital position $S_M$. Unfortunately, there need not be any satellite in position $S_M$. Under such circumstances, it is necessary to use an existing satellite that is close to the position $S_M$ e.g. $S_3$ for pointing purposes. This can be done by offsetting the source $S_3$ by an amount corresponding to the angle $S_3O_M$ and then applying the above-described pointing technique. This provides approximate pointing on $S_1$, $S_2$, $S_3$, and $S_4$. Under such circumstances, as can be seen in FIG. 5, the roll axis (C) corresponding to the roll angle is the axis extending towards the virtual satellite in orbital position $S_M$.

However, because the elevation corresponding to satellite $S_3$ is different from that corresponding to satellite $S_M$, pointing requires successive readjustments due in particular to how the roll angle is applied. In addition, this pointing is never optimal over all positions simultaneously. Furthermore, because the primary pointing is on a position other than $S_M$, pointing errors and elevation errors accumulate thus making it impossible to align $S_1$ and $S_2$ with a single roll angle starting from an intermediate position that is not in the middle. Consequently, the roll angle cannot satisfy both pointing on $S_1$ and on $S_2$, particularly when $S_3$ is far from $S_M$.

SUMMARY OF THE INVENTION

The object of the invention is to provide a method and a device enabling the above-described drawbacks of the prior art to be mitigated.

The method of the invention is characterized in that it comprises the steps of consisting in:

- offsetting said transceiver source on the focal line of the antenna through a distance d from the middle of said focal line so as to aim at one of the extreme positions $S_1$, $S_2$, said distance d being determined as a function of an angle $\alpha$ formed between a first line connecting the origin O of the focal axis of the reflector to the target extreme position and a second line connecting said origin O to the middle position $S_M$ of the geostationary orbit;
- turning the antenna through the angle $\alpha$ about an axis D perpendicular to the plane containing the focal line and the origin O of the focal axis; and
- adjusting the roll angle by turning the antenna about its own axis pointing to the satellite situated at the target extreme position, so as to aim at the other extreme position and bring the focal line into alignment with the set of satellites situated between the positions $S_1$ and $S_2$.

The first and second steps described above can be performed in either order.

According to another characteristic of the method of the invention, when the antenna has a plurality of sources, the height of each of them in a plane perpendicular to the plane containing the focal line and the origin O of the focal axis of the reflector is adjusted independently of the others.

The device for implementing the method of the invention is characterized in that it comprises a mechanism for fixing the antenna to said support, said mechanism also enabling the antenna to be turned through an angle $\alpha$ about an axis D perpendicular to the plane containing the focal line and the origin O of the focal axis of the reflector so as to steer the reflector transversely.

By means of the method and the device of the invention, pointing on different orbital positions is performed with great accuracy.

BRIEF DESCRIPTION OF THE DRAWINGS

Other characteristics and advantages of the invention appear from the following description taken as a non-limiting example and given with reference to the accompanying figures, in which.

DETAILED DESCRIPTION OF THE PREFERRED EMBODIMENT(S)

To make the method of the invention easier to understand, the following description is made with reference to an antenna having a reflector in a centered configuration and provided with five transceiver sources. Naturally, the invention is not limited to this type of antenna and the person skilled in the art can easily apply the invention to an antenna having a reflector in an offset configuration or having a focal line that has either a single transceiver source or as many sources as there are target orbital positions, and also to an array antenna with electronic scanning in the azimuth plane.

The term "focal line" is used to designate the locus of points on which the reflector focuses. Two singular points are the positions of the sources $s_1$ and $s_2$ corresponding to the satellites in the extreme target orbital positions, and a plane contains these two points and the origin O of the focal axis of the reflector. Nevertheless, the focal line is not necessary rectilinear.

Identical references are given to elements in the figures that perform the same functions.

Figure 1:
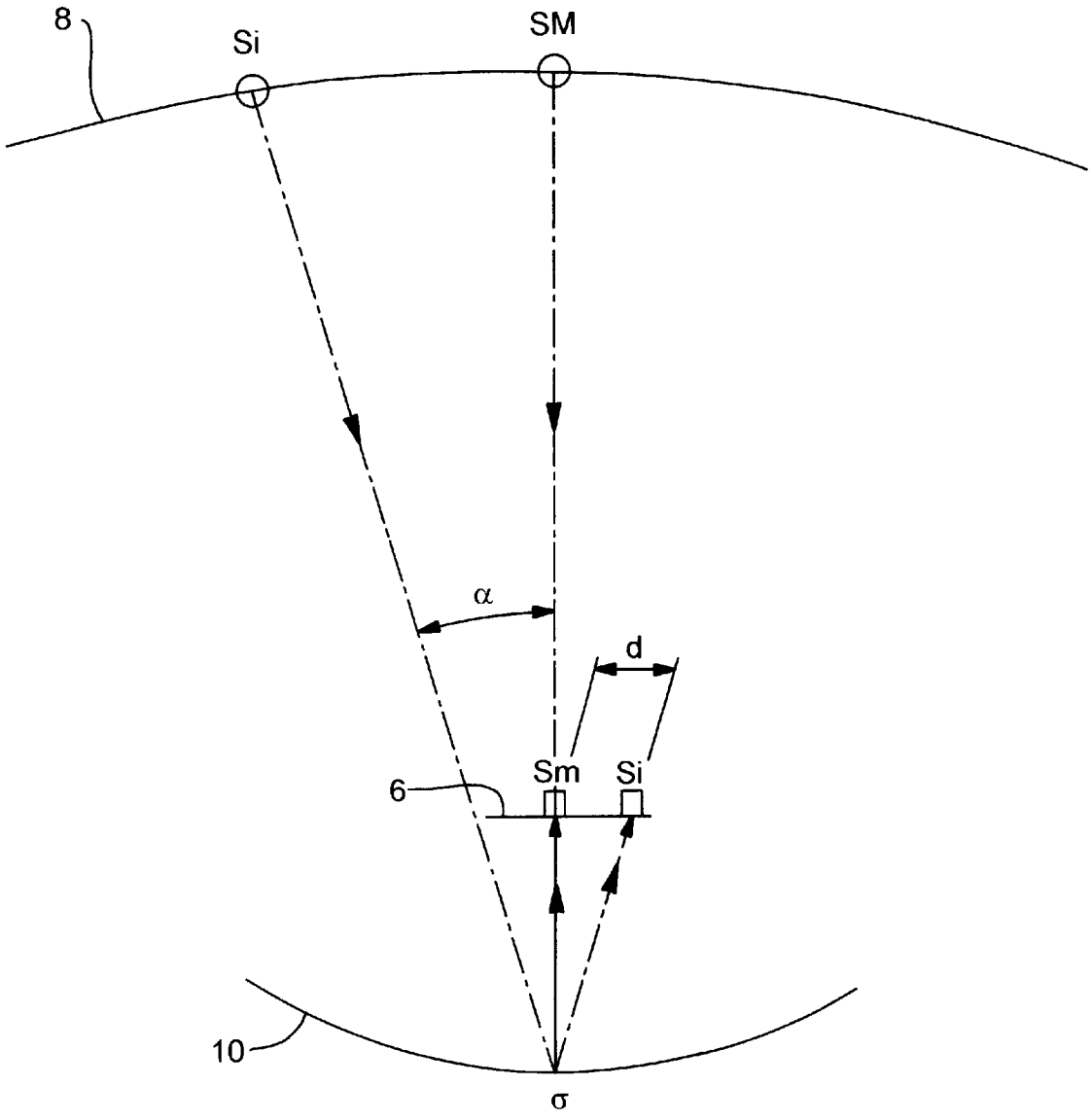
FIG. 1 Prior Art
FIGS. 1, 2, 3, and 4 are diagrams showing the operation of a prior art multi-satellite antenna.
Figure 2:
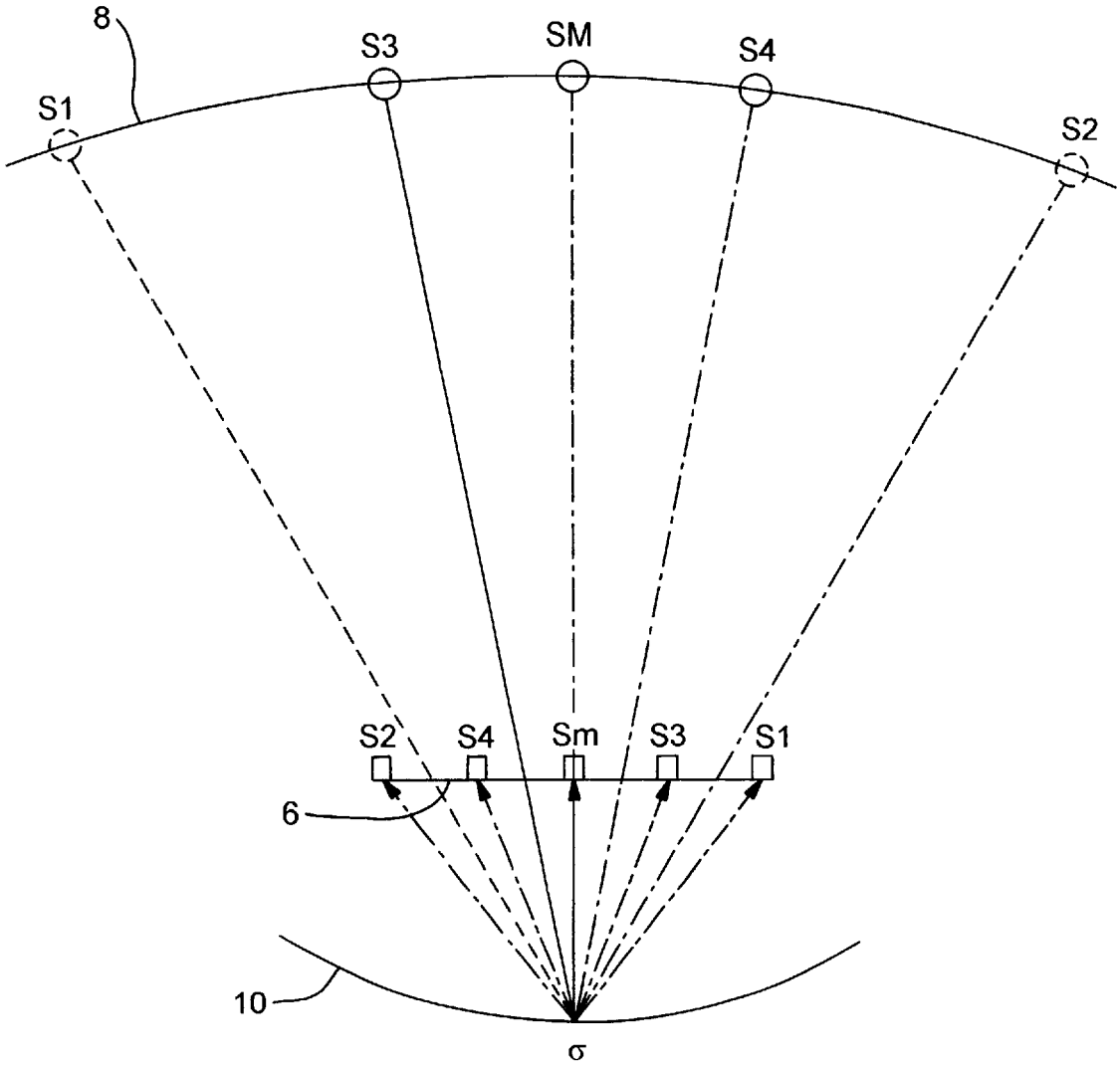
FIG. 2 Prior Art
Figure 3:
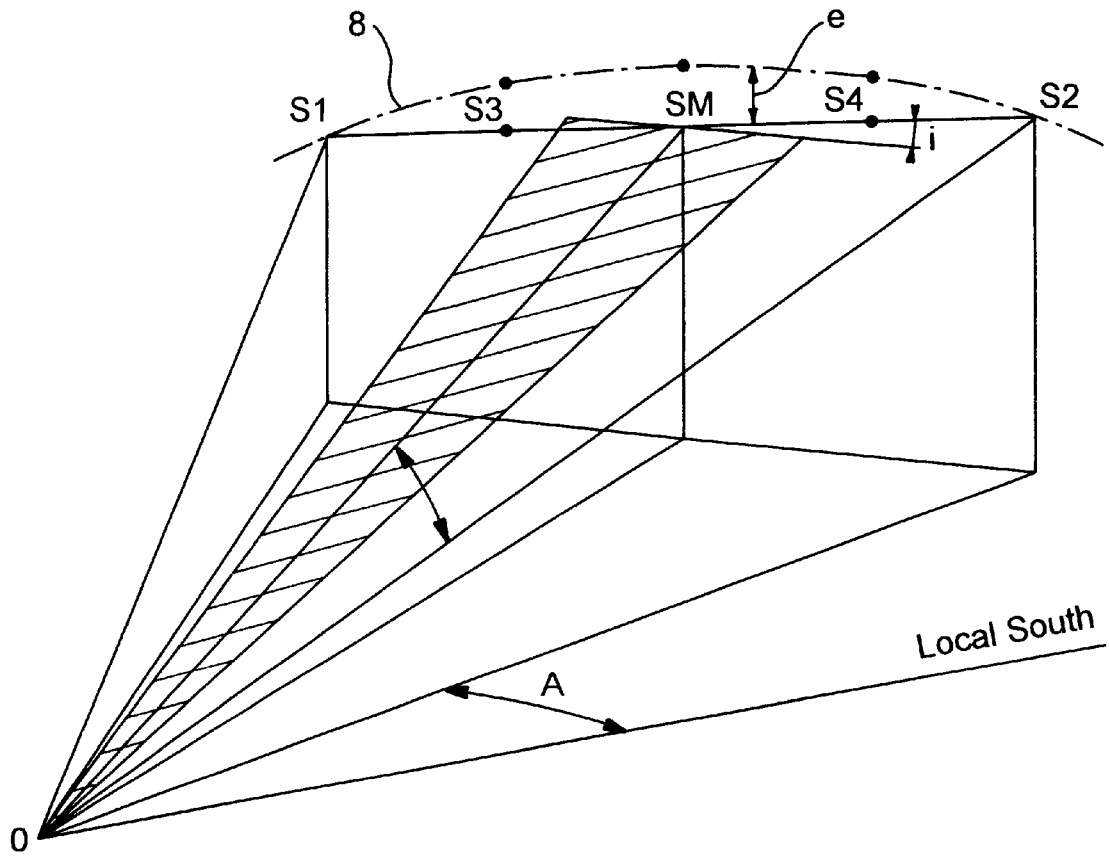
FIG. 3 Prior Art
Figure 4:
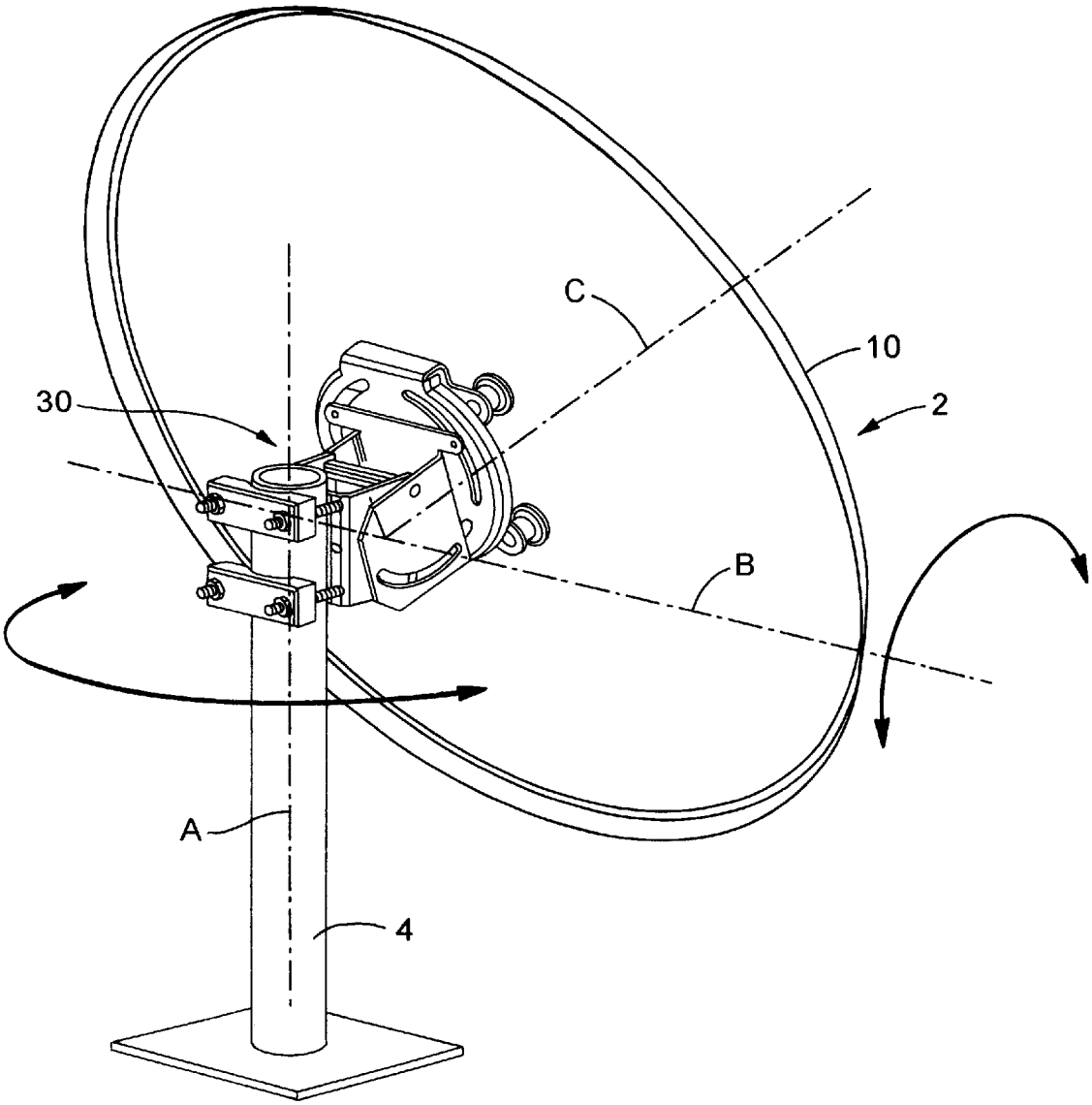
FIG. 4 Prior Art
Figure 5:
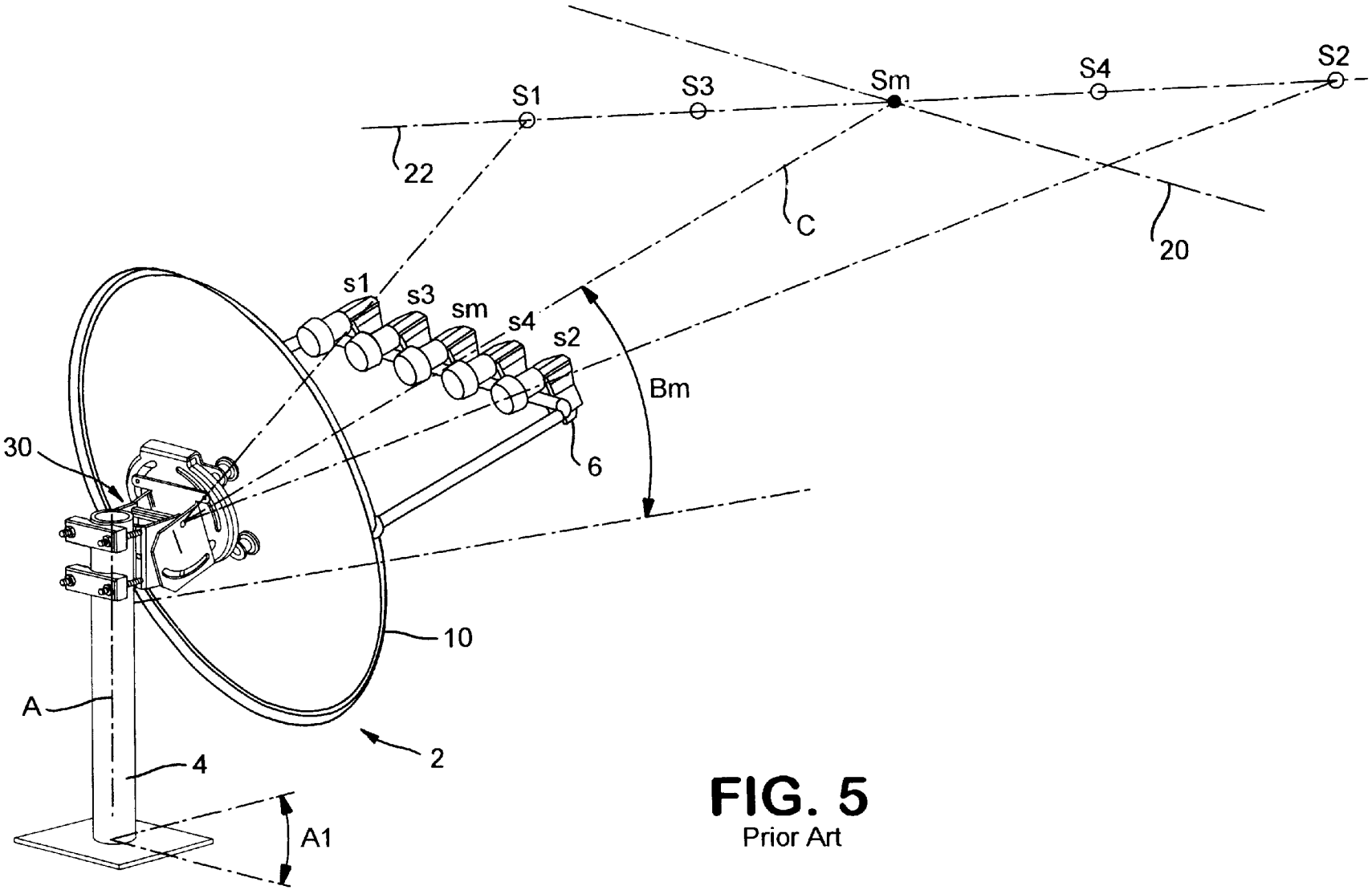
FIG. 5 Prior Art
FIG. 5 is a diagram showing how the FIG. 4 antenna is pointed.
Figure 6:
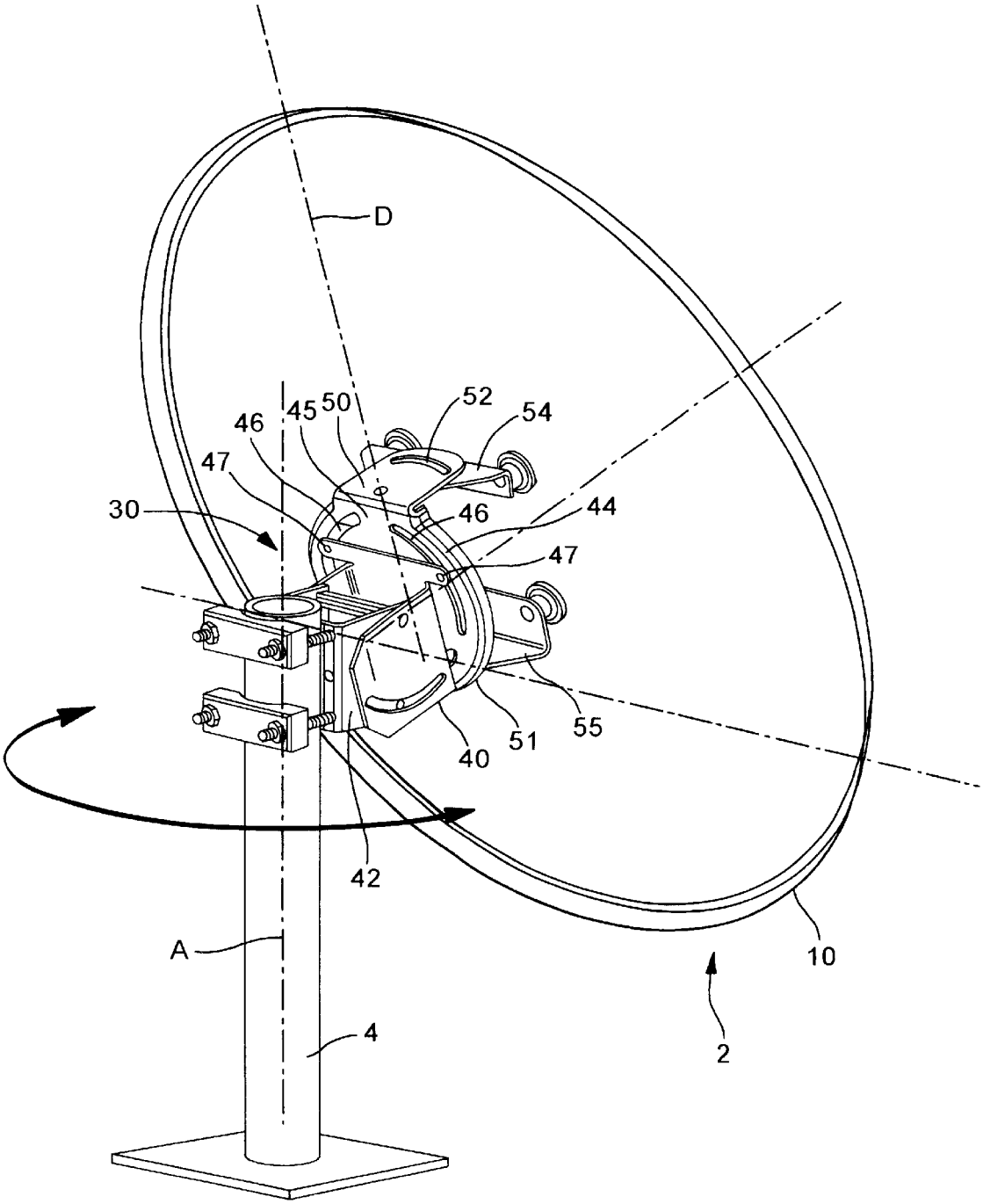
FIGS. 6 and 7 are perspective views of an antenna of the invention.
Figure 7:
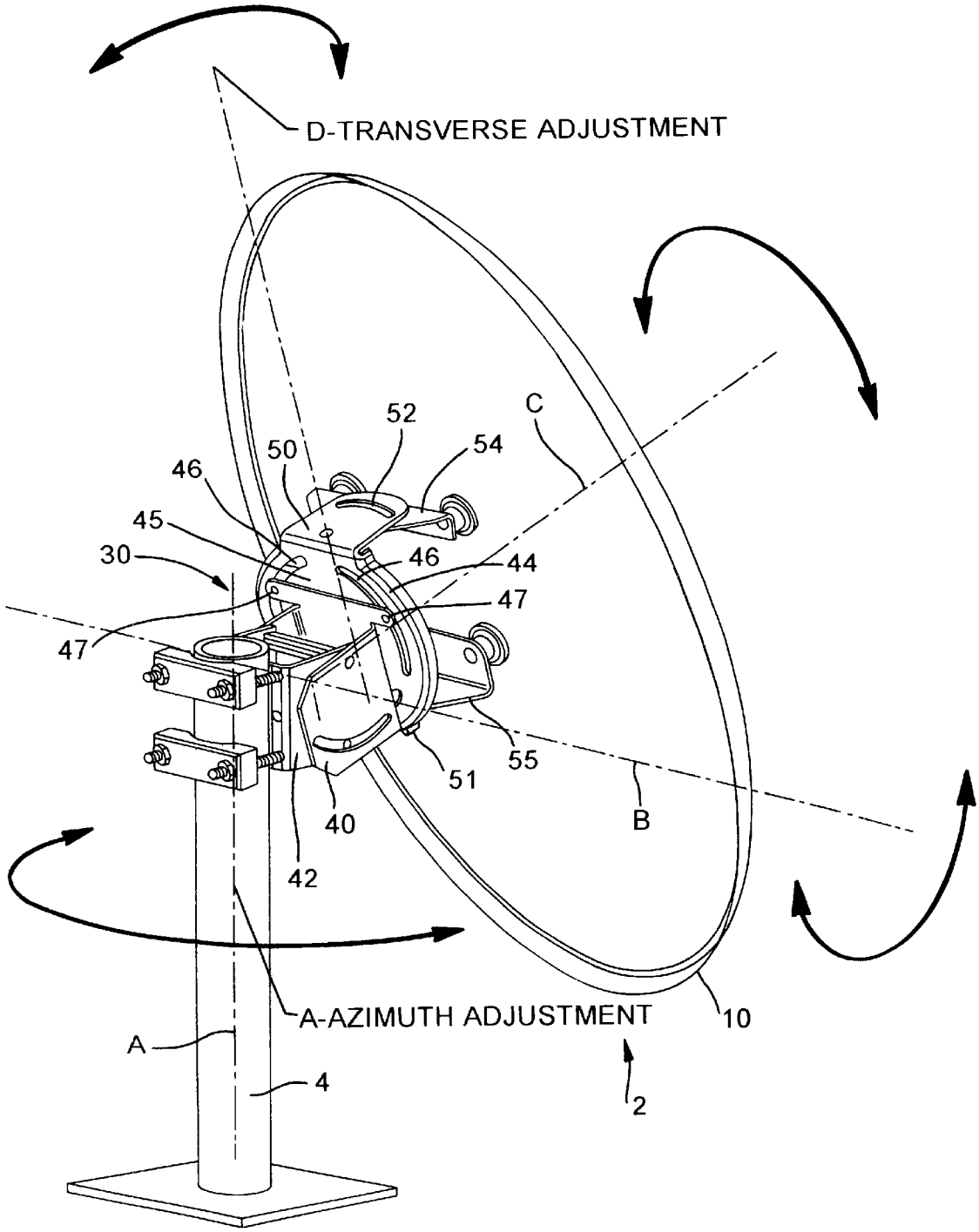
Figure 8:
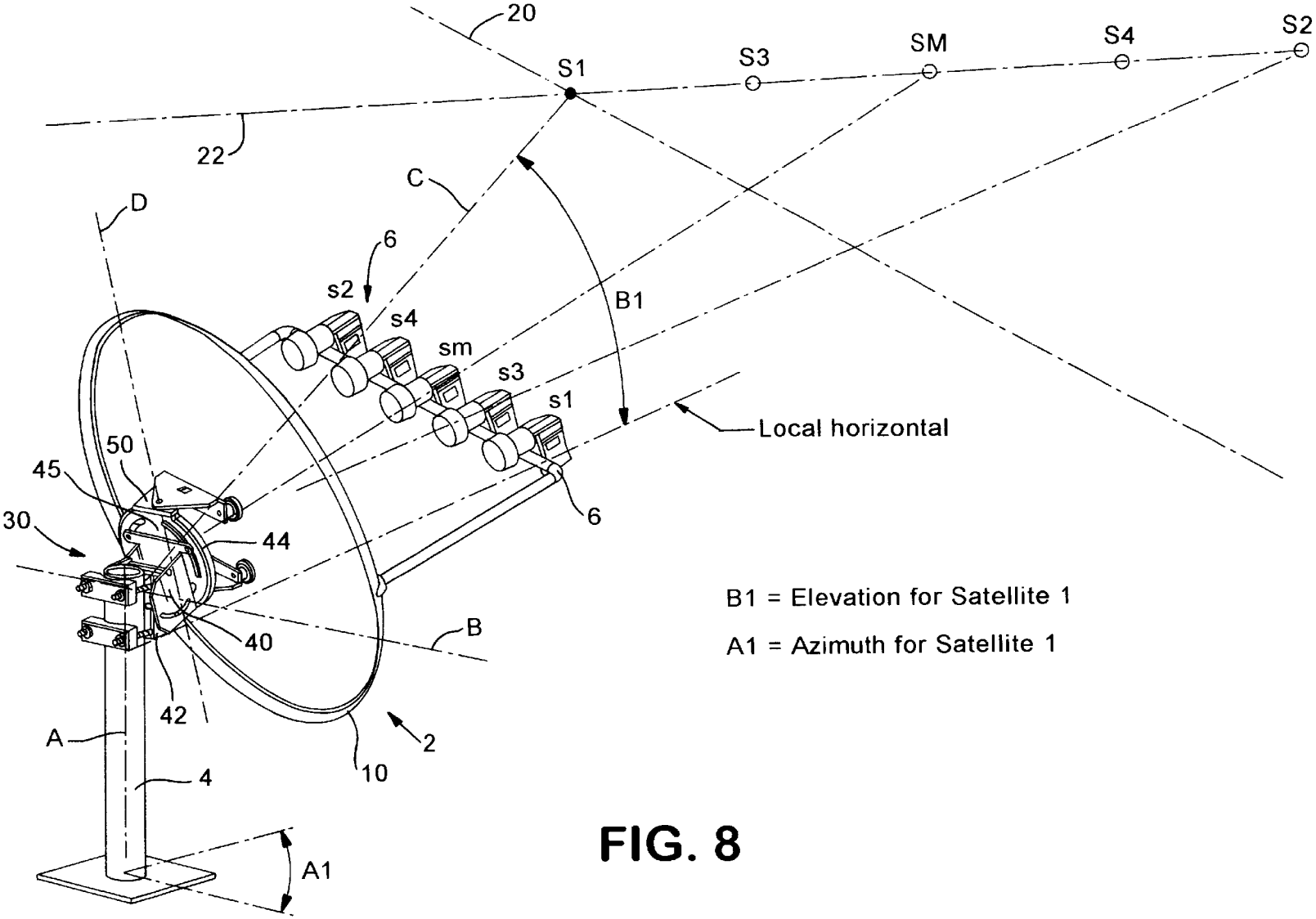
FIG. 8 is a diagram illustrating how the antenna of FIGS. 6 and 7 is pointed.
Figure 9:
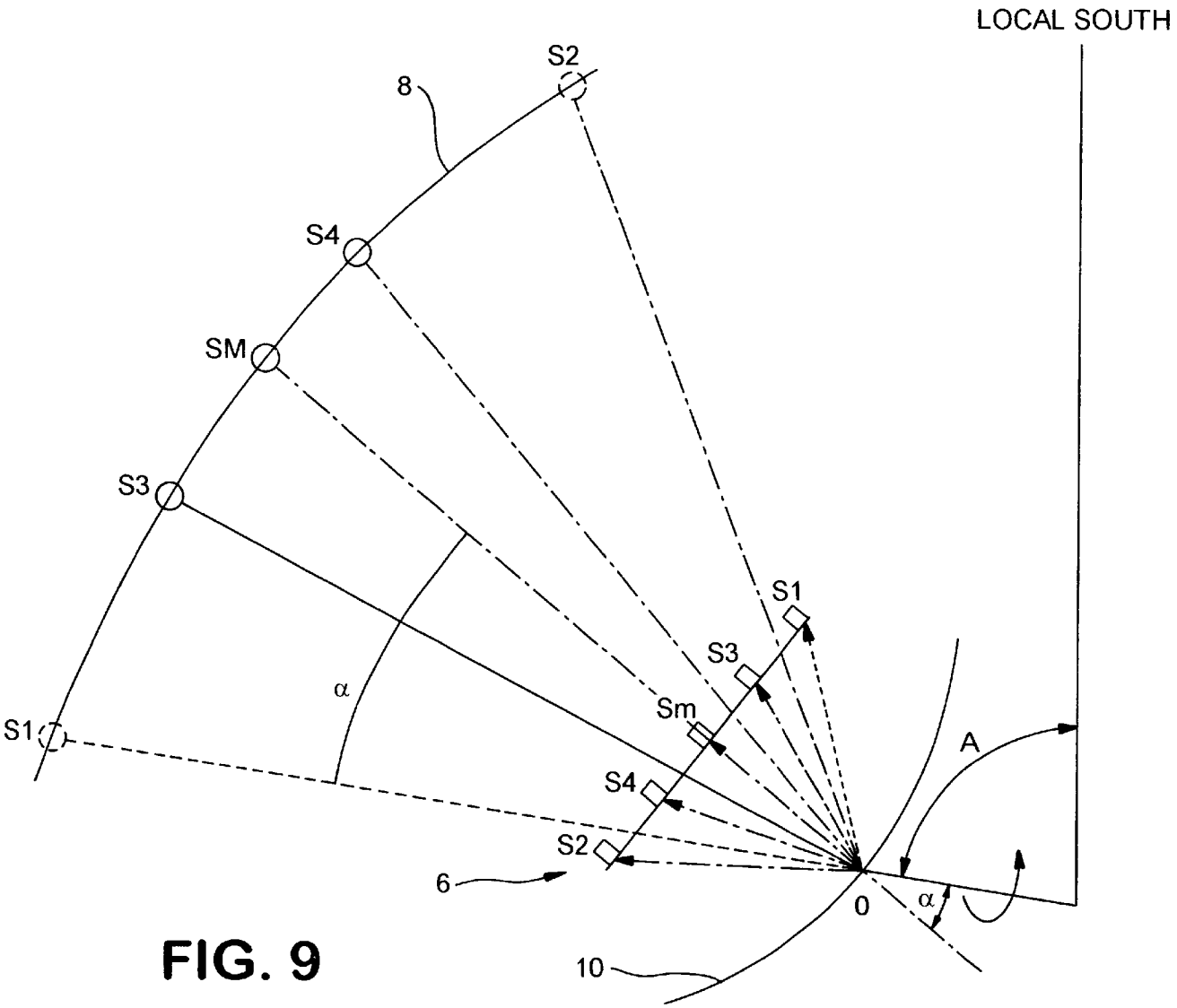
FIG. 9 is a diagrammatic plane view of the antenna of FIGS. 6 and 7.
Figure 10:
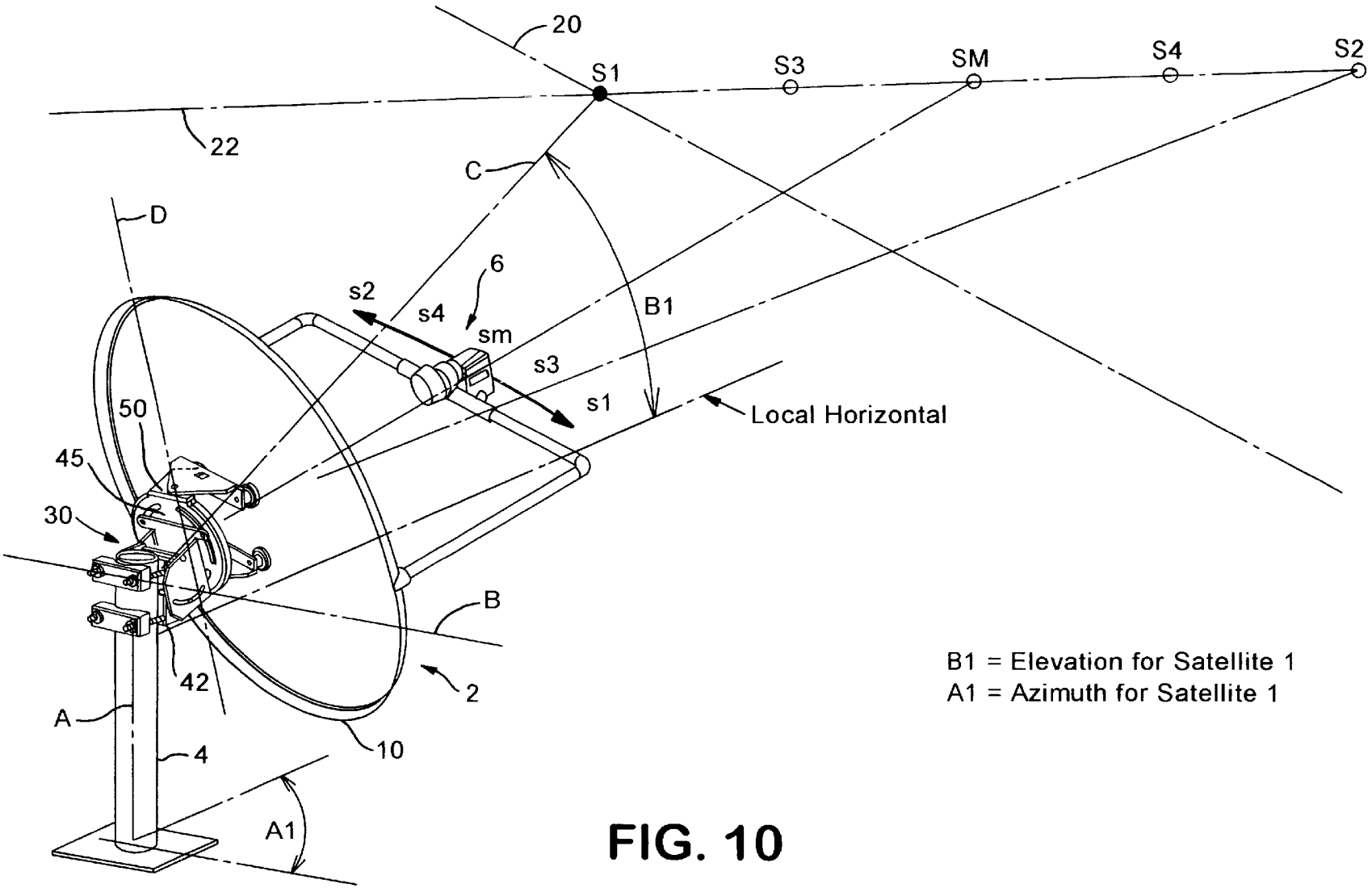
FIG. 10 is a diagram illustrating how an antenna with a motor-driven single source is pointed.

FIGS. 6, 7, and 8 show an antenna 2 having a reflector 10 of centered configuration mounted on a support 4 and provided with five transceiver sources $s_1$, $s_2$, $s_m$, $s_3$, and $s_4$ (FIG. 8) arranged on the focal line 6. Each of these transceiver sources corresponds to a satellite on the geostationary orbit 8.

Conventional pointing of such an antenna comprises adjusting the azimuth angle, adjusting the elevation angle, and adjusting the roll angle.

The azimuth angle is adjusted in conventional manner by turning about the axis A, the elevation angle is adjusted by turning about the axis B, while the roll angle is adjusted by turning about the axis C.

In addition to those adjustments, the method of the invention includes an additional adjustment which consists in offsetting one of said transceiver sources on the focal line 6 of the antenna 2 through a distance d relative to the middle of said focal line 6 so as to aim at one of the extreme positions $S_1$, $S_2$. The distance d is calculated as a function of the angle $\alpha$ between firstly the line extending from the origin O on the focal axis of the reflector 10 to the target extreme position, and secondly the line extending from said origin O to the middle position $S_M$ of the geostationary orbit. This step can be preceded or followed by a step consisting in turning the reflector 10 through the angle $\alpha$ about an axis D perpendicular to the plane containing the focal line 6 and the origin O of the focal axis. The roll angle is then adjusted by turning the antenna 2 about its own axis pointing at the satellite situated at the extreme target position, so as to aim at the other extreme position and align the focal line 6 on the set of satellites situated between the positions $S_1$ and $S_2$.

This is made possible by adding the transverse axis D and by adjusting the transverse angle to a predetermined value $S_1OS_M$ for the antenna being directed on $S_1$, or $S_2OS_M$ when the antenna is directed on $S_2$.

As can be seen in FIG. 8, before the above-described adjustment of the roll angle, the locus 20 of target orbital positions corresponding to the plane containing the sources $s_1$, $s_2$, $s_3$, $s_4$, and $s_m$ is not in alignment with the locus 22 containing the positions $S_1$, $S_2$, $S_3$, $S_4$, and $S_M$. By turning about the axis C, it is possible to bring these loci into alignment. The sources $s_3$ and $s_4$ corresponding respectively to satellites situated in positions $S_3$ and $S_4$ are positioned on the focal line 6 at angles $S_3OS_M$ and $S_4OS_M$ in order to aim at said satellites. The sources are adjusted in the direction perpendicular to the plane containing the focal line 6 and the origin O of the focal axis of the reflector 10 so as to compensate for the non-perfect alignment of the satellites situated on orbital positions $S_1$, $S_2$, $S_3$, $S_4$, and $S_M$.

The method of the invention is implemented by a pointing device comprising a mechanism 30 for fixing the antenna 2 on said support 4 and also making it possible to turn the reflector 10 through an angle $\alpha$ about the axis D so as to steer the reflector transversely.

In a particular embodiment of the invention shown in FIGS. 6 to 8, said mechanism 30 comprises a U-shaped first part 40 co-operating with a second part 42 fixed via one end to the support 4 while its other end is mounted to move between the side limbs of said U-shaped first part 40 so as to enable the elevation angle of the reflector 10 to be adjusted.

As can be seen in FIGS. 7 and 8, said first part 40 also co-operates with a third part 44 having a face 45 perpendicular to the focal axis of the reflector 10. This face 45 has slots 46 in which studs 47 secured to the U-shaped part 40 slide so as to enable the roll angle of the antenna 2 to be adjusted.

Said surface 45 also has top and bottom brackets 50 and 51 each pierced by the axis D so as to make it possible to perform adjustment of the angle $\alpha$. To this end, at least one of the said brackets 50, 51 has a slot 52 in which an arm 54, 55 slides for performing rotation about the axis D and for holding the transverse direction into which the reflector is steered.

Naturally, as mentioned above, the invention also applies to an antenna 2 having a single source that is motor-driven along the focal line 6 or a single source having a steerable radiation pattern.

In a particular element (not shown), the method is applied to pointing an array antenna with azimuth scanning which is fixed on a support 4 and has a plurality of radiating elements suitable for aiming at a plurality of satellites situated between two extreme positions $S_1$ and $S_2$ on a geostationary orbit 8.

Under such circumstances, the device for implementing the method has a mechanism 30 for fixing the antenna 2 on said support 4 so as to make it possible additionally to turn the array antenna 10 through an angle $\alpha$ about an axis D perpendicular to the azimuth scanning plane of the array so as to steer the array transversely.

What is claimed is:

1. A method for pointing a fixed antenna having a reflector and at least one transceiver source suitable for aiming at a set of a plurality of satellites located between two extreme positions $S_1$, $S_2$ on a geostationary orbit, the method comprising the steps of:

adjusting an azimuth angle of said antenna;

adjusting an elevation angle of said antenna;

offsetting said transceiver source on a focal line of the antenna through a distance d from a middle of said focal line so as to aim at one of the extreme positions $S_1$, $S_2$, said distance d being determined as a function of an angle $\alpha$ formed between a first line connecting an origin O of a focal axis of the reflector to said one of the extreme positions and a second line connecting said origin O to a middle position $S_M$ of the geostationary orbit;

turning the antenna through the angle $\alpha$ about an axis D perpendicular to a plane containing the focal line and the origin O of the focal axis; and adjusting a roll angle by turning the antenna about an axis connecting said origin O to a satellite situated at said one of the extreme positions, so as to aim at the other of said extreme positions and bring the focal line into alignment with the set of satellites situated between the extreme positions $S_1$ and $S_2$.

2. The method according to claim 1, further comprising adjusting the azimuth angle and the elevation angle of said antenna, corresponding to said one of the extreme positions.

3. The method according to claim 2, wherein said method is used for pointing a fixed antenna having as many sources as there are target orbital positions.

4. The method according to claim 3, further comprising adjusting a height of each of said sources in a plane perpendicular to the plane containing the focal line and the origin O of the focal axis of the reflector independently of the others.

5. The method according to claim 2, wherein said method is used for pointing a fixed antenna having a single source with a steerable radiation pattern.

6. The method according to claim 2, wherein said method is used for pointing a fixed antenna having a single source which is motor-driven along the focal line.

7. A device for pointing an antenna having a reflector fixed on a support and including at least one transceiver source suitable for aiming at a plurality of satellites situated between two extreme positions $S_1$ and $S_2$ on a geostationary orbit, the device comprising a mechanism for fixing the antenna to said support, said mechanism comprising means for adjusting the position of the antenna about an azimuth axis, means for adjusting the position of the antenna about an elevation axis, and means for adjusting the position of the antenna about an axis D perpendicular to a plane containing a focal line of the antenna and an origin O of a focal axis of the reflector so as to steer the reflector transversely.

8. The device according to claim 7, wherein the antenna has as many transceiver sources as there are target orbital positions.

9. The device according to claim 7, wherein the antenna has a single transceiver source with a steerable radiation pattern.

10. The device according to claim 7, wherein the antenna has a single source that is motor-driven along the focal line.

11. The device according to claim 7, wherein the mechanism comprises a U-shaped first part co-operating with a second part fixed at one end to the support while a second end is mounted to move between side limbs of said U-shaped first part so as to enable the elevation angle of the antenna to be adjusted.

12. The device according to claim 11, wherein said first part also co-operates with a third part having a face perpendicular to the focal axis of the reflector with slots formed therein slidably receiving studs secured to the U-shaped part so as to enable the roll angle of said antenna to be adjusted.

13. The device according to claim 12, wherein the face includes a top bracket and a bottom bracket each pierced by the axis D so as to enable the angle $\alpha$ to be adjusted.

14. The device according to claim 13, wherein at least one of said brackets includes a slot slidably receiving an arm for enabling the antenna to be turned about the axis D and enabling its transverse direction to be held.

15. A device for pointing an array antenna with azimuth scanning fixed on a support and including an array having a plurality of radiating elements suitable for aiming at a plurality of satellites situated between two extreme positions $S_1$ and $S_2$ on a geostationary orbit, the device comprising a mechanism for fixing the antenna to said support and comprising means for adjusting the position of the array antenna about an azimuth axis, means for adjusting the position of the array antenna about an elevation axis, and means for adjusting the position of the array antenna about an axis D perpendicular to an azimuth scanning plane of the array so as to steer the array antenna transversely, said axis D being distinct from said azimuth axis.

* * * * *